US005419054A

United States Patent [19]

Stoneberg

[11] Patent Number: 5,419,054

[45] Date of Patent: May 30, 1995

[54] TRIANGULAR DRAFTING INSTRUMENT

[75] Inventor: J. Bruce Stoneberg, La Grange, Ill.

[73] Assignee: Safe-T Products, LaGrange, Ill.

[21] Appl. No.: 1,562

[22] Filed: Jan. 6, 1993

[51] Int. Cl.[6] ..... B43L 7/027

[52] U.S. Cl. ..... 33/474; 33/476

[58] Field of Search ..... 33/474, 476, 482

[56] References Cited

U.S. PATENT DOCUMENTS

| | | | |
|---|---|---|---|
| 306,869 | 10/1884 | Scott | 33/474 |
| 629,078 | 7/1899 | Holz | 33/474 |
| 855,987 | 6/1907 | Schlageter | 33/474 |
| 1,155,059 | 9/1915 | Heathcote | 33/474 |
| 1,619,427 | 3/1927 | McCaffery, Jr. | 33/476 |
| 2,122,732 | 7/1938 | Uyeda et al. | 33/474 |
| 2,214,408 | 9/1940 | De V. Arizpe | 33/474 |
| 3,181,243 | 5/1965 | Zajac et al. | 33/474 |
| 3,375,589 | 4/1968 | Dolgorukov | 33/474 |

FOREIGN PATENT DOCUMENTS

| | | | |
|---|---|---|---|
| 591014 | 6/1925 | France | 33/480 |
| 606280 | 11/1934 | Germany | 33/476 |
| 0826200 | 11/1951 | Germany | 33/474 |
| 386883 | 1/1933 | United Kingdom | 33/480 |

*Primary Examiner*—Thomas B. Will

*Attorney, Agent, or Firm*—Laff, Whitesel, Conte & Saret

[57] ABSTRACT

A flat triangular piece, usually of shatter resistant plastic, is formed with straight edges and is used in connection with a T-square for drawing perpendicular lines and geometric shapes. The outside peripheral corners are rounded for safety purposes and the intermediate portions of the legs are slotted or recessed to permit the utilitarian reproduction of triangular lines and shapes with sharp points.

5 Claims, 1 Drawing Sheet

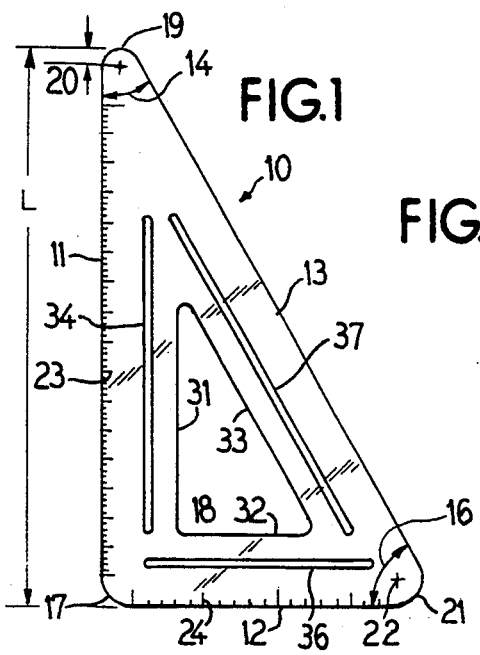
FIG.1
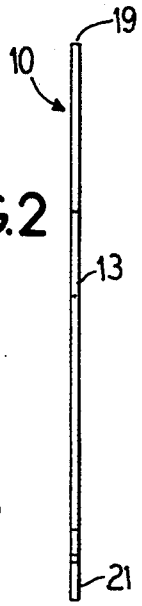
FIG.2
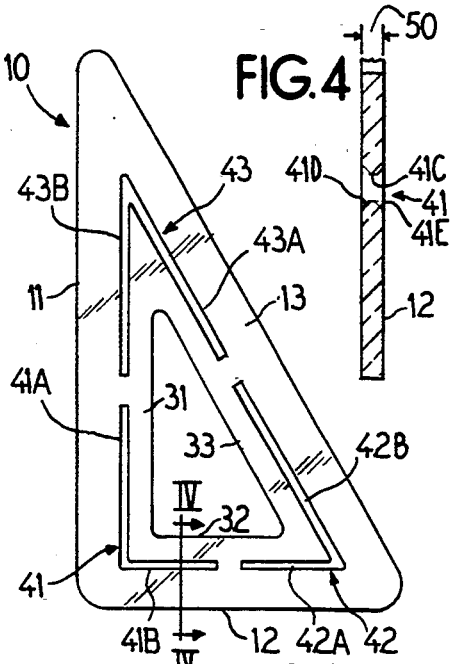
FIG.4
FIG.3
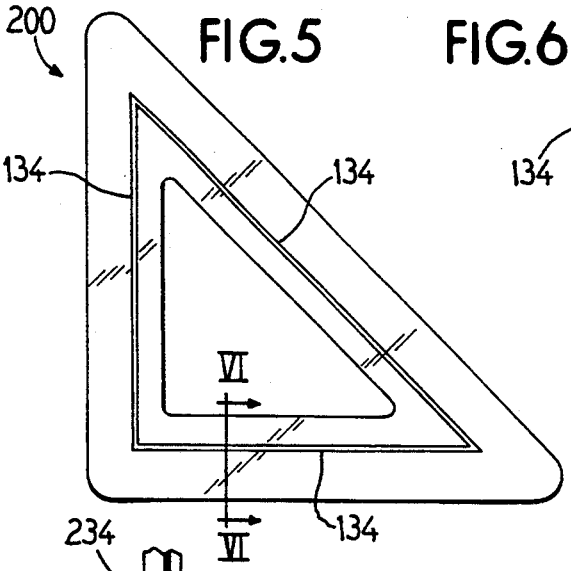
FIG.5
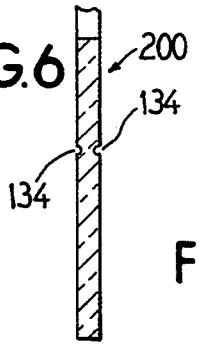
FIG.6
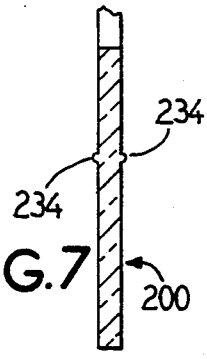
FIG.7
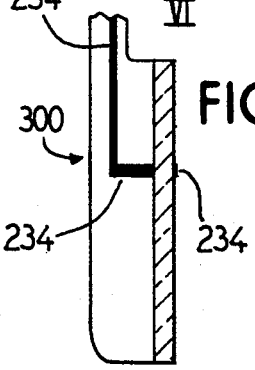
FIG.8
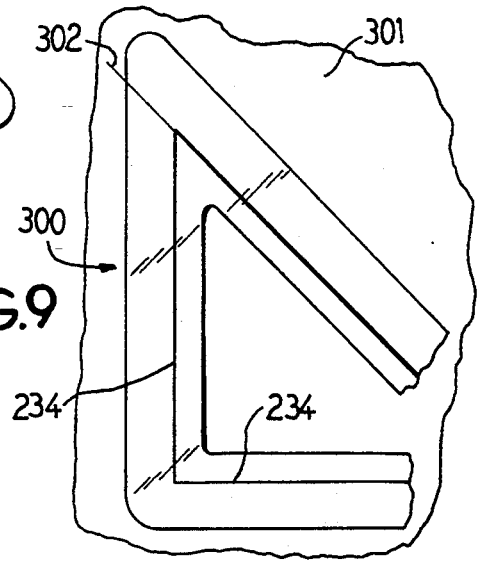
FIG.9

TRIANGULAR DRAFTING INSTRUMENT

BACKGROUND OF THE INVENTION

1. Field of the Invention

This invention relates generally to drafting instruments and more specifically to an improved triangle which has safety features that insure safe operations for children and beginning and other users of the instrument.

1. The Prior Art

Triangular drafting instruments are well known in the prior art and are customarily made of wood, plastic or metal in a generally flat configuration and shaped to provide three legs disposed in a triangular disposition. A particularly common form of triangle is a so-called right triangle wherein two of the legs are straight edges and intersect one another at a right angle, i.e., with an included angle of 90 degrees. The third leg then forms the hypotenuse of the triangle and may define with the other legs an included angle of selected size, usually 30, 45 or 60 degrees.

With such prior art devices, the included angle forms a sharp point, so sharp that a careless user may inflict serious harm to either the user or to others, whether intentionally, or accidentally. The sharp points, even on triangles made of a pliable plastic, may have such a potential for penetration, that even a casual contact with a resisting surface such as the skin of a person, may result in the infliction of a serious wound.

In the hands of a user bent on anti-social behavior, such a triangle could well function as a weapon. Yet, the elimination of the sharp corners seriously handicaps the legitimate use of the device in drawing triangular shapes and in the utilitarian exploitation of the triangle.

SUMMARY OF THE INVENTION

The present invention contemplates the provision of a triangle wherein the included angles of the device are gently rounded to define a radius of curvature so that all sharp corners are eliminated on the peripheral outside edges. Internally of the outside peripheral edges, there are formed through slots or grooves in the shape of the triangular configuration to be reproduced. Such slots or grooves may either be joined, or partially joined, at intersecting corners, to allow the user the maximum flexibility in the utilitarian application of the device.

Alternatively, the present invention contemplates that the triangle may be made of a material such that it will be transparent or translucent and the inwardly spaced grooves, slots, or even shoulders, may be formed on the device and selectively aligned by the user with complementary lines or shapes already inscribed on a workpiece.

DESCRIPTION OF THE DRAWINGS

FIG. 1 is an elevational view of a triangle provided in accordance with the principles of the present invention;

FIG. 2 is a side elevational view of the triangle of FIG. 1;

FIGS. 3 and 5 are elevational views of an alternative forms of a triangle provided in accordance with the principles of the present invention;

FIG. 4 is a fragmentary cross sectional view taken on line IV—IV of FIG. 3;

FIG. 6 is a fragmentary cross sectional view taken on line VI—VI of FIG. 5;

FIG. 7 is a fragmentary cross sectional view taken on the same plane as FIG. 6, but showing a modified form of the invention;

FIG. 8 is a an angled view, partly in section, and fragmentary in part, for the purpose of showing one corner of a modified form of the invention;

FIG. 9 is a fragmentary elevational view of a modified form of the invention situated in place on a background consisting of a sheet of paper worksheet on which marks are being inscribed.

DESCRIPTION OF THE PREFERRED EMBODIMENTS

The invention is described in connection with the application of the inventive principles to either a well known form of 30–60–90 degree triangle or 45 degree triangle used in basic geometry, art, drawing and drafting classes in elementary, secondary and advanced schooling as well as those used and displayed in office supply and art catalogs.

As has been observed, a conventional triangle made of conventional material with its sharp corners and conventional flat shape can be a dangerous weapon, if used for anti-social purposes or if utilized as a frisbee or other mischievous purpose for which it is not normally intended.

In accordance with the principles of the present invention, the material from which the devices are made is a shatter resistant transparent or transluscent material. For example, one such material is commercially available under the trade name "K-Resin" (Phillips). The corners of the triangle are rounded by forming the corners on a gentle radius of curvature so that all sharp corners are completely eliminated on the outer peripheral edges of the device.

Referring to the drawings and particularly to FIG. 1, there is disclosed a triangle shown generally at 10 in the configuration of a right triangle, i.e., there is a first leg 11 and a second leg 12, both of which are disposed in a right angular relationship to one another.

A third leg 13 is disposed to join the legs 11 and 12 and constitutes the hypotenuse of the triangle. It will be noted that in the form of the invention illustrated in FIG. 1, the triangle is a so-called 30–60–90 triangle and, accordingly, the included angle between the leg 11 and the leg 13 is shown at 14 and constitutes an angle of 30 degrees. The included angle between the leg 12 and the leg 13 is shown at 16 and constitutes an angle of 60 degrees. The included angle between the legs 11 and 12 is a 90 degree angle.

It will be noted that the corners of the triangle 10 are rounded, the first rounded corner being shown at 17 and disposed on a radius of curvature indicated at 18. The second corner is rounded as at 19 and is disposed on a radius of curvature indicated at 20. The third rounded corner is shown at 21 and is disposed on a radius of curvature 22.

The radius of curvature 20 having a magnitude typical of a safe radius of curvature according to the invention and as per the figure, is approximately ⅛ inch or greater. Per FIG. 1, the ratio between the radius of curvature 20 and a length L of the leg 11, the longest leg, is approximately 3.4%.

In order to enhance the utilitarian purposes of the triangle 10, the legs 11 and 12 are formed with precalibrated measurements and such calibrations may be placed in the legs 11 and 12 by means of embossments or by inscribing suitable indicia thereon.

In the form of the invention of FIG. 1, the leg 11 is inscribed with measurements calibrated in metric measure shown at 23. The calibrations shown at 24 on leg 11 are calibrated in terms of British or English units.

In drawing a triangle with the use of the triangle instrument 10, or other geometric figure, the user starts with one straight line and makes the second line to be drawn meet the first line at a predetermined angle.

With the instrument of FIG. 1, any of the outside edges of the triangle 10 may be utilized as they would be in a conventional drafting instrument to draw the first line of an angle.

In accordance with the principles of the present invention, additional means are provided which can take several forms. In the form of the invention shown in FIG. 1, the triangle 10 has a hollow open interior which is circumscribed by inside edges shown at 31, 32 and 33. The inside edges 31, 32 and 33 are spaced inwardly and are disposed in parallel relation to the outside edges of the legs 11, 12 and 13, respectively. Thus, each of the legs 11, 12 and 13 are provided with finite width. Spaced intermediate the inside and outside edges of the leg 11, there is provided a slot 34 constituting a through opening and which is a straight linear elongated recess.

A similar elongated slot 37 is formed in the leg 13 intermediate the inner and outer edges and is disposed in parallel relation to such inner and outer edges. A slot 36 in elongated form is formed in the leg 12 intermediate the inner and outer edges thereof and is also parallel to the inner and outer edges.

In the form of the invention illustrated in FIGS. 3 and 4, a slot is shown generally at 41, but is formed to have two separate components, namely, a first component 41A which is formed in the leg 11 intermediate the inner and outer edges and extending parallel thereto from a point approximately in the middle of the leg and extending down towards the leg 12. A second component is shown at 41B and is disposed intermediate the inner and outer edges of the leg 12 and extends approximately to the midpoint of leg 12.

A second slot is shown at 42 and includes a first component 42A disposed in the leg 12 and a second component 42B disposed in the leg 13.

A third slot is shown at 43 and includes a first component 43A disposed in the leg 13 and a second component 43B disposed in the leg 11. Each of the legs 42 and 43 exhibits a sharp corner at the point of intersection between the respective components 42A and 42B and 43A and 43B.

In the form of the invention illustrated in FIG. 5, there is disclosed a 45 degree triangle 200 which in all structure and functional effects generally resembles the triangles of FIGS. 1 through 4 inclusive. However, in the triangle 200, instead of slots 34, 36 and 37, as shown in FIG. 1 or instead of the slots 41, 42 and 43 as shown in FIG. 3, the intermediate portions of the legs of the triangle 200 are provided with either embossments 134 as depicted in FIGS. 5 and 6 or with debossments 234 as depicted in FIG. 7.

In the case of the embossments 134, the recesses are disposed on opposite sides of the triangle and are formed in the intermediate portions of the legs between the inner and outer edges and are parallel to the inner and outer edges. By making the triangle 200 of transparent or translucent plastic, the existence of lines already drawn on a workpiece is readily discernible thereby permitting the embossments 134 or the debossments 234 to be aligned therewith for utilitarian purposes.

It will be understood that the debossments 234 are likewise disposed on the opposite surfaces of the triangle 200 in intermediate spaced relation between the inner and outer edges of the triangle and parallel to such edges.

In the form of the invention shown in FIGS. 8 and 9, a triangle is shown at 300 and the view of FIG. 8 is looking at one corner of the triangle as it is turned to reveal a line indicia drawn on the leg of the triangle at an intermediate location between the inner and outer edges and parallel thereto. The line 234 appears on the opposite side as shown in FIG. 8.

In FIG. 9, a workpiece is shown at 301 on which the triangle 300 is positioned. It will be noted that a line 302 has already been inscribed on the workpiece 301 thereby permitting the lines 234 to be placed in register therewith.

As noted above, with the three different forms of the invention, the first line of an angle may be aligned either with an opening in the triangle parallel to the edges as depicted in FIG. 1 or in FIG. 3 or may be aligned with the embossments or debossments of FIGS. 5, 6 and 7 or with the printed lines on the surface of the triangle 300 as shown in FIGS. 8 and 9. In each instance, the triangle may be moved by sliding on the workpiece forward to the point where the second leg of the angle meets the first and a perfect angle of 30 degrees, 60 degrees or 90 degrees may be drawn.

Referring further to FIGS. 3 and 4, it will be noted that the thickness or width of the triangle 10 is depicted by the dimension 50 shown in FIG. 4. Depending on the dimensional extent of such thickness 50, the slots or openings 41, 42 and 43 may be tapered to accommodate either a pencil or a pen used for marking the workpiece. Thus, as shown in FIG. 4, the size of the opening 41 is shown at 41C. That opening can taper outwardly towards one side or the other side of the triangle 10 as shown at 41D and if the opening is centrally disposed, the tapers can extend in both directions as shown at 41D and 41E. Such tapered disposition allows flexibility in the manipulation of the pencil/pen points used in applying indicia markings to the underlying workpieces.

In drawing lines with the use of the triangle shown in FIGS. 3 and 4, various angles and/or triangles or various geometric shapes can be drawn as previous described, Additionally, the openings 41, 42 and 43 can be used to make a complete triangle without regard to the outside edges and the rounded corners 17, 19 and 21. Where the slots 41, 42 and 43 are, in effect, broken off at the intermediate portions, the triangular instrument is readily moved one way or the other to complete the extent of the line.

Although minor modifications might be suggested by those versed in the art, it should be understood that I wish to embody within the scope of the patent warranted hereon all such modifications as reasonably and properly come within the scope of my contribution to the art.

I claim as my invention:

1. A triangle of the type used for drawing and alignment purposes comprising:

a flat triangular piece including three legs each having inner and outer peripheral edges and forming straight edges on the side, end and hypotenuse on the outer peripheral edges of said triangular piece for drawing lines; and at least two individual pairs of longitudinal slots formed between and parallel to said inner and outer peripheral edges through which a drafting instrument may be passed, each of said individual pairs of longitudinal slots meeting to provide a slot along the vertex formed by a pair of adjacent legs of said triangular piece.

2. A triangle as defined in claim 1 wherein rounded corners are formed on said triangle and said rounded corners comprise a radius of curvature of 2/16 inch or greater.

3. A triangle as defined in claim 1 wherein rounded corners are formed on said triangle said rounded corners comprise a radius of curvature of 2/16 inch or greater, and the proportion of the radius of curvature of each rounded corner to the length of the longest side of the triangle is approximately 3% or greater.

4. A triangle as defined in claim 1 including rounded corners formed on the outer peripheral corners thereof.

5. A triangle as defined in claim 1 wherein three of said individual pairs of longitudinal slots are provided, one pair of slots in each of said three pairs of adjacent legs defining the three corners of said triangular piece.

* * * * *